US011129241B2

(12) United States Patent
Li

(10) Patent No.: US 11,129,241 B2
(45) Date of Patent: Sep. 21, 2021

(54) CERAMIC HEATING ELEMENT WITH MULTIPLE TEMPERATURE ZONES

(71) Applicant: Key Material Co., Ltd., Dongguan (CN)

(72) Inventor: Guoming Li, Lixi Town (CN)

( * ) Notice: Subject to any disclaimer, the term of this patent is extended or adjusted under 35 U.S.C. 154(b) by 177 days.

(21) Appl. No.: 16/000,702

(22) Filed: Jun. 5, 2018

(65) Prior Publication Data

US 2019/0274357 A1 Sep. 12, 2019

(30) Foreign Application Priority Data

Mar. 7, 2018 (CN) ..... 201820314163.0

(51) Int. Cl.

| | |
|---|---|
| ***A24F 47/00*** | (2020.01) |
| ***F28F 21/04*** | (2006.01) |
| ***H05B 1/02*** | (2006.01) |
| ***A24F 40/46*** | (2020.01) |
| *H05B 3/14* | (2006.01) |

(52) U.S. Cl.

CPC ..... *H05B 1/0227* (2013.01); *A24F 40/46* (2020.01); *F28F 21/04* (2013.01); *H05B 3/141* (2013.01)

(58) Field of Classification Search

CPC ..... F28F 21/04; H05B 1/0227; H05B 3/141; A24F 47/008; A24F 40/46

USPC ..... 219/535

See application file for complete search history.

(56) References Cited

U.S. PATENT DOCUMENTS 3,956,614 A * 5/1976 Hervert ..... F01N 3/2026 219/541
4,035,613 A * 7/1977 Sagawa ..... H05B 3/18 219/552
4,512,871 A * 4/1985 Kato ..... G01N 27/4067 204/427
4,716,279 A * 12/1987 Hori ..... H05B 3/22 219/505
4,851,808 A * 7/1989 Sugata ..... C23C 16/26 338/308
5,063,029 A * 11/1991 Mizuno ..... H05B 3/12 422/175
5,304,778 A * 4/1994 Dasgupta ..... F23Q 7/001 123/145 A
5,420,395 A * 5/1995 Hyllberg ..... G03G 15/0233 219/470

(Continued)

FOREIGN PATENT DOCUMENTS

CN 204334973 U 5/2015

*Primary Examiner* — Eric S Stapleton

(57) ABSTRACT

The utility model discloses a ceramic heating element with multiple temperature zones, which comprises a ceramic heating element. The ceramic heating element consists of a first ceramic substrate, a second ceramic substrate, a heating circuit, an electrode pad, a heating temperature zone, an independent electrode lead and a common electrode, the first ceramic substrate and the second ceramic substrate are stacked and rolled to form a cylindrical or elliptic structure with a center hole, the heating circuit is printed on a front face of the second ceramic substrate, a plurality of electrode pads are printed on a back face of the second ceramic substrate, and a plurality of through holes are machined on an upper surface of the second ceramic substrate. The utility model has the beneficial effects of a simple structure and strong practicability.

2 Claims, 4 Drawing Sheets

(56) References Cited

U.S. PATENT DOCUMENTS 5,468,936 A * 11/1995 Deevi ..... H05B 3/141 219/543
5,602,325 A * 2/1997 McClanahan ..... G01N 27/4062 204/424
5,688,424 A * 11/1997 Asida ..... H01C 1/034 219/531
5,732,318 A * 3/1998 Natsuhara ..... G03G 15/2064 219/216
5,750,958 A * 5/1998 Okuda ..... F23Q 7/001 123/145 A
5,753,893 A * 5/1998 Noda ..... C04B 35/111 219/548
5,756,215 A * 5/1998 Sawamura ..... C04B 35/117 219/541
5,804,797 A * 9/1998 Kaimoto ..... H05B 3/141 219/505
6,073,340 A * 6/2000 Shirai ..... G01N 27/4067 219/542
6,084,220 A * 7/2000 Suematsu ..... F23Q 7/001 219/270
6,118,110 A * 9/2000 Kobayashi ..... C04B 37/008 219/548
6,143,238 A * 11/2000 Konishi ..... F23Q 7/001 264/614
6,169,275 B1 * 1/2001 Noda ..... H05B 3/141 219/542
6,194,693 B1 * 2/2001 Shirai ..... G01N 27/4067 219/552
7,078,659 B2 * 7/2006 Yokoyama ..... H05B 3/06 204/424
7,827,847 B2 * 11/2010 Oishi ..... H01M 8/04089 73/23.2
7,919,734 B2 * 4/2011 Sakurai ..... H05B 3/141 219/553
8,158,909 B2 * 4/2012 England ..... H01M 8/04022 219/270
8,167,192 B1 * 5/2012 Kim ..... H05B 3/141 228/121
8,333,315 B2 * 12/2012 Luo ..... H05B 3/84 228/122.1
8,359,905 B2 * 1/2013 Suzuki ..... C04B 37/026 73/31.05
8,604,396 B2 * 12/2013 Takenouchi ..... H05B 3/18 219/544
8,981,266 B2 * 3/2015 Lewis ..... B64D 15/12 219/541
8,993,940 B2 * 3/2015 Winter ..... H05B 3/36 219/541
9,549,472 B2 * 1/2017 Shibutani ..... H05K 3/3436
2001/0003336 A1 * 6/2001 Abbott ..... F27D 11/02 219/543
2001/0054610 A1 * 12/2001 Watanabe ..... C04B 41/009 219/544
2002/0139671 A1 * 10/2002 Kato ..... H05B 3/141 204/431
2002/0170903 A1 * 11/2002 Taniguchi ..... F23Q 7/001 219/270
2002/0175156 A1 * 11/2002 Hotta ..... F02P 19/028 219/270
2003/0029856 A1 * 2/2003 Tatematsu ..... H05B 3/141 219/270
2003/0042242 A1 * 3/2003 Taniguchi ..... H05B 3/141 219/270
2003/0042243 A1 * 3/2003 Taniguchi ..... F23Q 7/001 219/270
2003/0044173 A1 * 3/2003 Natsuhara ..... H05B 3/265 392/479
2004/0035843 A1 * 2/2004 Hamilton ..... G03G 15/2064 219/216
2004/0065881 A1 * 4/2004 Ito ..... H01L 21/67109 257/48
2004/0094871 A1 * 5/2004 Ito ..... C04B 35/58 264/434
2004/0104212 A1 * 6/2004 Gadow ..... H05B 3/00 219/465.1
2004/0117977 A1 * 6/2004 Hiramatsu ..... H05B 3/141 29/611
2005/0016986 A1 * 1/2005 Ito ..... H05B 3/141 219/444.1
2005/0051299 A1 * 3/2005 Graham ..... F28F 9/06 165/82
2005/0236398 A1 * 10/2005 Yokoyama ..... H05B 3/141 219/544
2005/0269749 A1 * 12/2005 Itoh ..... C04B 35/6303 264/618
2006/0016802 A1 * 1/2006 Takamura ..... H05B 3/141 219/543
2006/0170113 A1 * 8/2006 Tanaka ..... H01L 23/49822 257/778
2007/0043399 A1 * 2/2007 Stevenson ..... A61N 1/3754 607/37
2007/0221661 A1 * 9/2007 Nagasako ..... H01C 1/144 219/544
2008/0023467 A1 * 1/2008 Sakurai ..... H05B 3/141 219/553
2008/0191236 A1 * 8/2008 De Graaf ..... F28D 15/0233 257/99
2008/0210684 A1 * 9/2008 Kukino ..... B28B 11/242 219/542
2009/0194519 A1 * 8/2009 Funaki ..... F23Q 7/001 219/270
2010/0288746 A1 * 11/2010 Takenouchi ..... H05B 3/48 219/209
2010/0288747 A1 * 11/2010 Yamamoto ..... H05B 3/141 219/270
2010/0294300 A1 * 11/2010 Takenouchi ..... H05B 3/141 132/229
2011/0061444 A1 * 3/2011 Suzuki ..... G01N 27/4067 73/25.01
2011/0068091 A1 * 3/2011 Hiura ..... F23Q 7/001 219/270
2011/0114622 A1 * 5/2011 Sekiguchi ..... F23Q 7/001 219/270
2013/0022069 A1 * 1/2013 Lee ..... H01S 5/02292 372/38.02
2013/0160730 A1 * 6/2013 Kan ..... H05B 3/141 123/145 A
2013/0220676 A1 * 8/2013 Kawaguchi ..... H05K 1/0203 174/252
2013/0241046 A1 * 9/2013 Miyashita ..... H01L 23/4006 257/705
2014/0376202 A1 * 12/2014 Shibutani ..... H05K 3/3436 361/767
2015/0001077 A1 * 1/2015 Oya ..... G01N 27/4067 204/424
2015/0053217 A1 * 2/2015 Steingraber ..... A24F 47/008 131/329
2015/0192545 A1 * 7/2015 Sugiyama ..... G01N 27/70 73/28.01
2015/0334776 A1 * 11/2015 Kumazawa ..... H05B 3/0014 219/547
2016/0070225 A1 * 3/2016 Akiyama ..... H01C 17/06 219/535
2016/0334814 A1 * 11/2016 Dinkel ..... F24C 7/067
2017/0045435 A1 * 2/2017 Sugiyama ..... G01N 15/0656
2017/0105454 A1 * 4/2017 Li ..... A24F 47/008
2017/0211454 A1 * 7/2017 Matsuoka ..... G01N 15/0656
2017/0307498 A1 * 10/2017 Sugiyama ..... G01N 27/60

* cited by examiner

CERAMIC HEATING ELEMENT WITH MULTIPLE TEMPERATURE ZONES

FIELD OF THE INVENTION

The utility model relates to the field of ceramic heating elements, and in particular to a ceramic heating element with multiple temperature zones.

BACKGROUND OF THE INVENTION

E-cigarettes which are also known as electronic cigarettes are mainly used to quit smoking and replace cigarettes. Moreover, an e-cigarette heating element is an important part of an e-cigarette. A traditional e-cigarette heating element has two kinds of heating units, one of which is a heating wire, but the heating wire is located at an air vent of the heating element and its material is not corrosion-resistant such that the heating wire becomes a consumable part, and another structure of the heating element consists of an inner core (i.e. a blank), an outer layer and a substrate for clamping a heating wire such that the heating element has a relatively thick overall structure, a slow heating rate and poor heating effects, and its long-term use can cause the fracture of the inner core and the substrate, thus greatly shortening the service life. However, with the development of industrial technologies, ceramic heating elements are more and more widely applied to the field of e-cigarette heating elements and gradually replacing traditional e-cigarette heating elements due to their advantages of cleanliness, harmlessness, acid resistance, alkali resistance, high temperature resistance and a high heating rate.

Chinese Patent Document CN 204334973 U discloses a heating element for an e-cigarette, wherein a heating circuit is printed on a superimposed surface between two ceramic substrates to prevent the heating circuit from contacting the outside air and being oxidized by the outside air such that the heating circuit can still maintain a good heating effect for a long time. However, in the above patent, the ceramic heating element is not heated based on temperature zones, and therefore cannot be heated by stages.

With the development of science and technology and the progress of society, people have gradually increasing requirements on material life, and more and more people choose to quit smoking for their health. There are a variety of ways to quit smoking, in which e-cigarettes are very popular with people, but traditional e-cigarettes internally comprise heating elements with complex mounting structures and have a relatively short service life, and therefore have higher cost after their long-term use. However, ceramic heating elements can overcome the disadvantages of traditional heating elements, but existing ceramic heating elements cannot achieve multi-temperature zone heating. Accordingly, it is necessary to design a ceramic heating element with multiple temperature zones so as to solve the above problems.

SUMMARY OF THE INVENTION

An object of the utility model is to provide a ceramic heating element with multiple temperature zones so as to solve the above problems.

To achieve the above object, the utility model employs the following technical solution: a ceramic heating element with multiple temperature zones comprises a ceramic heating element, wherein the ceramic heating element consists of a first ceramic substrate, a second ceramic substrate, a heating circuit, electrode pad, a heating temperature zone, an independent electrode lead and a common electrode, the first ceramic substrate and the second ceramic substrate are stacked and rolled to form a cylindrical or elliptic structure with a center hole, the heating circuit is printed on a front face of the second ceramic substrate, a plurality of electrode pads are printed on a back face of the second ceramic substrate, a plurality of through holes are machined on an upper surface of the second ceramic substrate, the electrode pads are connected with the heating circuit via the through holes, the heating circuit is divided into a plurality of heating temperature zones, and each of the heating temperature zones is internally correspondingly provided with two independent electrode leads or one independent electrode lead and one common electrode.

The ceramic heating element has a hollow cylindrical shape or a ceramic sheet inside.

The independent electrode lead and the common electrode are respectively communicated with the corresponding electrode pads.

The electrode pads are welded with metal leads by a brazing method.

The ceramic heating element is cylindrical or elliptic cylindrical.

Both of the first ceramic substrate and the second ceramic substrate are forming by a casting process.

The ceramic heating element with multiple temperature zones manufactured by the technical solution of the utility model has the advantages of simple operation, low manufacturing cost, use of a ceramic heating element which can be conveniently mounted and has a fast heating rate and a long service life, and adoption of multi-temperature zone heating which can achieve zone-based heating, thus being suitable for popularization and use.

In the Figures: 1. first ceramic substrate; 2. second ceramic substrate; 3. heating circuit; 4. electrode pad; 5. heating temperature zone; 6. independent electrode lead; 7. common electrode; 8. ceramic sheet; 9. ceramic heating element.

DETAILED DESCRIPTION OF THE INVENTION

Figure 1:
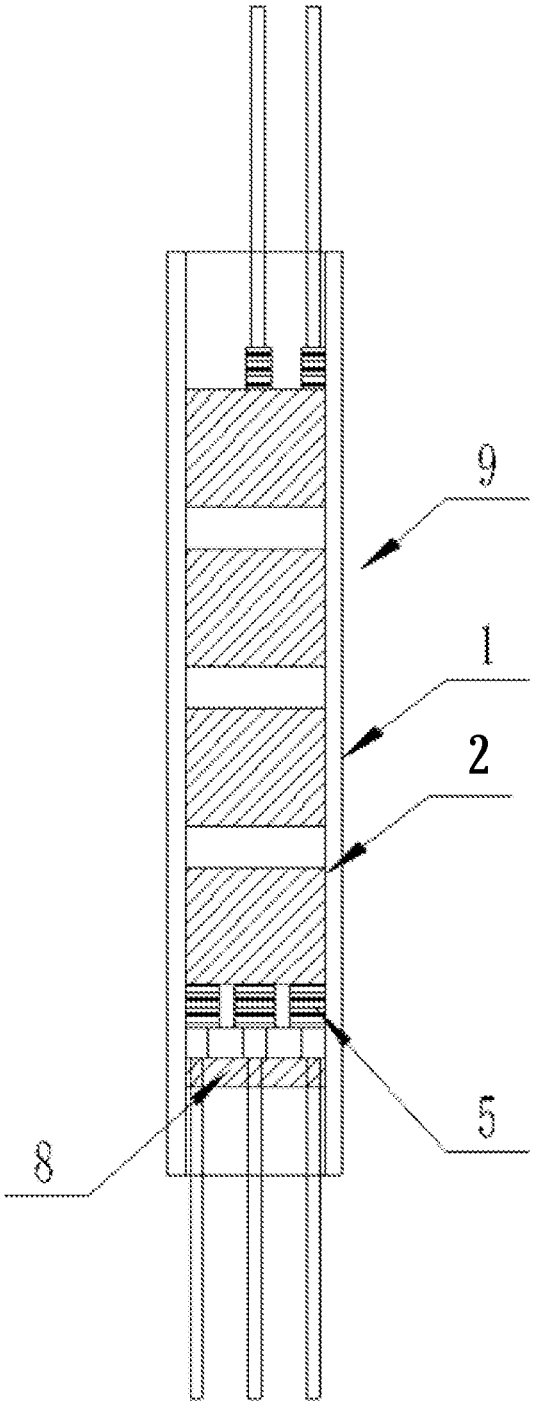
FIG. 1 is a schematic structural view of a ceramic heating element with multiple temperature zones according to the utility model.
Figure 2:
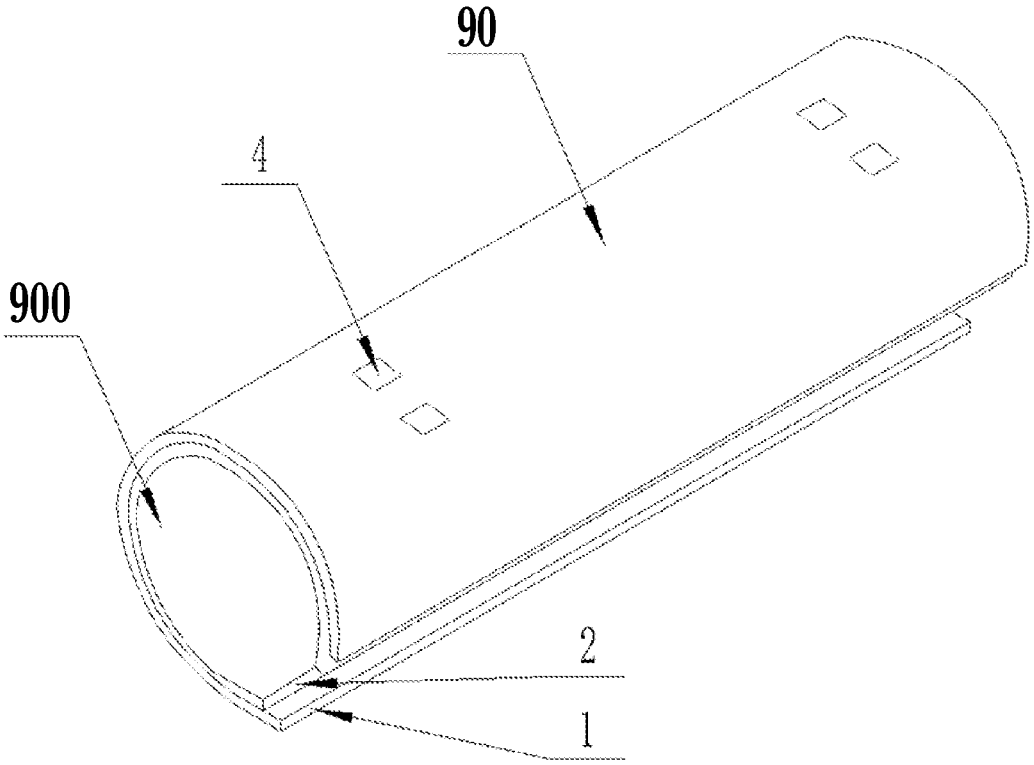
FIG. 2 is a schematic view of rolled ceramic substrates of the ceramic heating element with multiple temperature zones according to the utility model.
Figure 3:
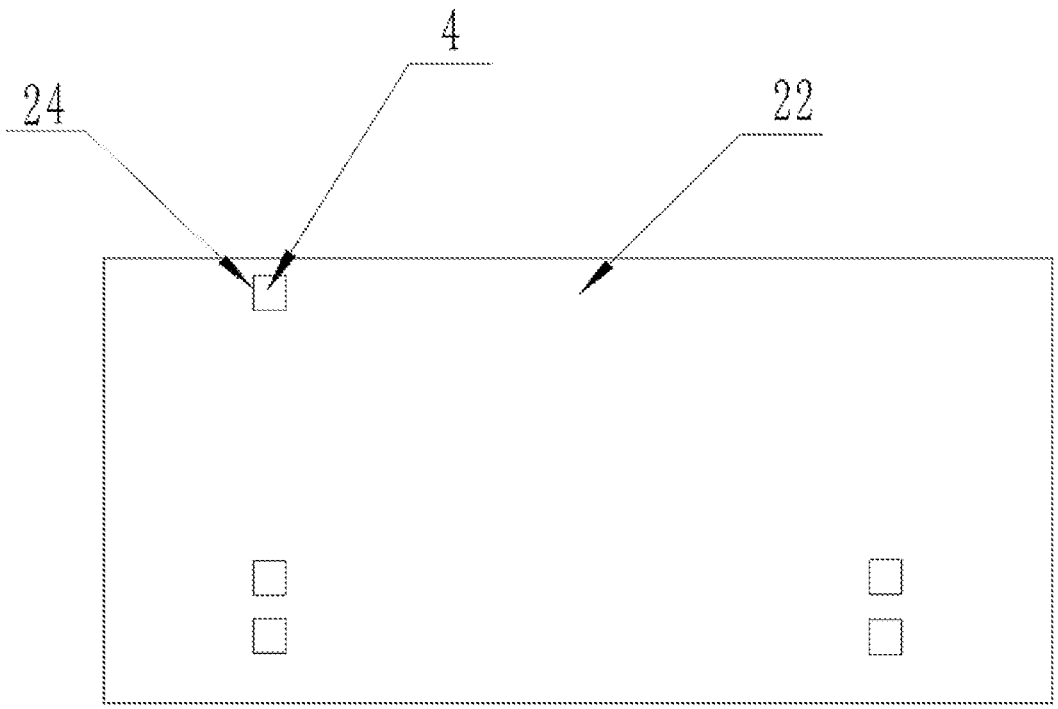
FIG. 3 is a schematic view of a back face of a second ceramic substrate of the ceramic heating element with multiple temperature zones according to the utility model.
Figure 4:
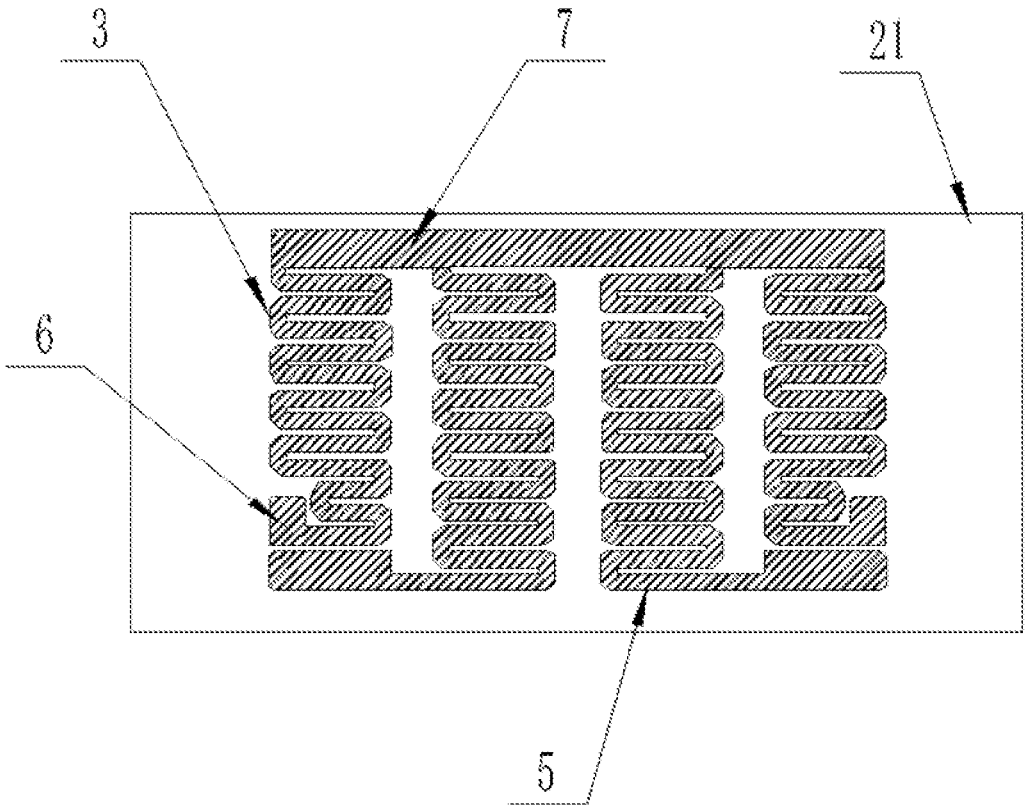
FIG. 4 is a schematic view of a front face of the second ceramic substrate of the ceramic heating element with multiple temperature zones according to the utility model.

The utility model will be specifically described below with reference to the drawings. As shown in FIGS. 1 to 4, a ceramic heating element with multiple temperature zones comprises a ceramic heating element 9, wherein the ceramic heating element 9 consists of a first ceramic substrate 1, a second ceramic substrate 2, a heating circuit 3, an electrode pad 4, a heating temperature zone 5, an independent electrode lead 6 and a common electrode 7, the first ceramic substrate 1 and the second ceramic substrate 2 are stacked and rolled to form a cylindrical or elliptic structure 90 with a center hole 900, the heating circuit 3 is printed on a front face 21 of the second ceramic substrate 2, a plurality of electrode pads 4 are printed on a back face 22 of the second ceramic substrate 2, a plurality of through holes 24 are machined on an upper surface of the second ceramic substrate 2, the electrode pads 4 are connected with the heating circuit 3 via the through holes 24, the heating circuit 3 is divided into a plurality of heating temperature zones 5, and each of the heating temperature zones 5 is internally correspondingly provided with two independent electrode leads 6 or one independent electrode lead 6 and one common electrode 7; the ceramic heating element 9 has a hollow cylindrical shape or a ceramic sheet 8 inside; the independent electrode lead 6 and the common electrode 7 are respectively communicated with the corresponding electrode pads 4; the electrode pads 4 are welded with metal leads by a brazing method; the ceramic heating element is cylindrical or elliptic cylindrical; and both of the first ceramic substrate 1 and second ceramic substrate 2 are formed by a casting process.

This embodiment is characterized in that: the ceramic heating element 9 consists of a first ceramic substrate 1, a second ceramic substrate 2, a heating circuit 3, an electrode pad 4, a heating temperature zone 5, an independent electrode lead 6 and a common electrode 7, the first ceramic substrate 1 and the second ceramic substrate 2 are stacked and rolled to form a cylindrical or elliptic structure with a center hole, the heating circuit 3 is printed on a front face of the second ceramic substrate 2, a plurality of electrode pads 4 are printed on a back face of the second ceramic substrate 2, a plurality of through holes are machined on an upper surface of the second ceramic substrate 2, the electrode pads 4 are connected with the heating circuit 3 via the through holes, the heating circuit 3 is divided into a plurality of heating temperature zones 5, and each of the heating temperature zones 5 is internally correspondingly provided with two independent electrode leads 6 or one independent electrode lead 6 and one common electrode 7. The ceramic heating element with multiple temperature zones has the advantages of simple operation, low manufacturing cost, use of a ceramic heating element which can be conveniently mounted and has a fast heating rate and a long service life, and adoption of multi-temperature zone heating which can achieve zone-based heating, thus being suitable for popularization and use.

In this embodiment, firstly, the utility model provides a ceramic heating element with multiple temperature zones, which comprises a ceramic heating element 9. The ceramic heating element 9 consists of a first ceramic substrate 1, a second ceramic substrate 2, a heating circuit 3, an electrode pad 4, a heating temperature zone 5, an independent electrode lead 6 and a common electrode 7. In particular, the first ceramic substrate 1 and the second ceramic substrate 2 are stacked and rolled to form a cylindrical or elliptic structure with a center hole, the heating circuit 3 is printed on a front face of the second ceramic substrate 23 while a plurality of electrode pads 4 are printed on a back face of the second ceramic substrate 2, and then a plurality of through holes are machined on an upper surface of the second ceramic substrate 2, wherein the electrode pads 4 are connected with the heating circuit 3 via the through holes. The heating circuit 3 is then divided into a plurality of heating temperature zones 5, and each of the heating temperature zones 5 is internally correspondingly provided with two independent electrode leads 6 or one independent electrode lead 6 and one common electrode 7. Subsequently, either a hollow cylindrical shape is machined or a ceramic sheet 8 is placed inside the ceramic heating element. In the present device, the independent electrode lead 6 and the common electrode 7 are respectively communicated with the corresponding electrode pads 4. In particular, the electrode pads 4 are welded with metal leads by a brazing method. The ceramic heating element is cylindrical or elliptic cylindrical. Both of the first ceramic substrate 1 and the second ceramic substrate 2 are formed by a casting process and made of one of alumina, aluminum nitride, silicon nitride and zirconium oxide or a combination thereof. In particular, the thickness of the first ceramic substrate 1 and the second ceramic substrate 2 is maintained at 0.1-0.6 MM.

The above technical solution merely represent a preferred technical solution of the utility model, and some possible changes made to certain parts therein by those skilled in the art embody the principles of the utility model and belong to the protection scope of the utility model.

The invention claimed is:

1. A ceramic heating element having a hollow cylindrical shape and comprising:

a first ceramic substrate;

a second ceramic substrate;

a heating circuit;

a plurality of electrode pads;

a plurality of through holes; and a plurality of heating temperature zones, the first ceramic substrate and the second ceramic substrate being stacked and rolled to form a hollow cylindrical structure with a center hole, the first ceramic substrate being arranged around the second ceramic substrate, the heating circuit being printed on a front face of the second ceramic substrate away from the first ceramic substrate, the plurality of electrode pads being printed on a back face of the second ceramic substrate facing the first ceramic substrate, the plurality of through holes being machined on the second ceramic substrate, the plurality of electrode pads being connected with the heating circuit via the through holes, the heating circuit being divided into the plurality of heating temperature zones, and each of the plurality of heating temperature zones being internally correspondingly provided with one independent electrode lead and one common electrode, wherein a ceramic sheet is placed inside the ceramic heating element.

2. The ceramic heating element according to claim 1, wherein the one independent electrode lead and the one common electrode are respectively communicated with a corresponding electrode pad of the plurality of electrode pads.

* * * * *